United States Patent [19]

Orban

[11] 4,330,737

[45] May 18, 1982

[54] ELECTRONIC FLASH SYSTEM

[75] Inventor: Jean M. Orban, Santa Monica, Calif.

[73] Assignee: Vivitar Corporation, Los Angeles, Calif.

[21] Appl. No.: 113,769

[22] Filed: Jan. 21, 1980

[51] Int. Cl.[3] ..... H05B 41/32

[52] U.S. Cl. ..... 315/241 P; 315/151; 315/171; 315/173; 315/240

[58] Field of Search ..... 315/171–173, 315/240, 241 R, 241 P, 151, 159, 340

[56] References Cited

U.S. PATENT DOCUMENTS

| | | | |
|---|---|---|---|
| 3,033,988 | 5/1962 | Edgerton | 250/205 |
| 3,591,829 | 7/1971 | Murata et al. | 315/151 |
| 3,626,246 | 12/1971 | Higuchi | 315/151 X |
| 3,716,752 | 2/1973 | Iwata | 315/151 |
| 3,781,602 | 12/1973 | Tadokoro | 315/241 P |
| 3,783,336 | 1/1974 | Vital et al. | 315/159 |
| 3,809,951 | 5/1974 | Vital et al. | 315/159 X |
| 3,857,064 | 12/1974 | Vital et al. | 315/241 P |
| 3,912,968 | 10/1975 | Nakamura | 315/241 P |
| 4,151,446 | 4/1979 | Ludloff | 315/171 X |

FOREIGN PATENT DOCUMENTS 41-1055366 6/1966 Japan .

*Primary Examiner*—Eugene R. La Roche
*Attorney, Agent, or Firm*—Lyon & Lyon

[57] ABSTRACT

There is disclosed herein an electronic flash system which obviates the need for the typical large capacity main capacitor as the power source for the flashtube. The system includes a conventional flashtube, trigger circuit for ionizing the flashtube and control circuit for turning on and off an electronic switching element which applies the main operating power to the flashtube. The ignition circuit for the flashtube uses a relatively small capacitor which is charged to a high voltage level for first igniting the flashtube and causing it to commence emission of light. Once ignited, a medium voltage power supply supplies the necessary current level for the required length of time to continue the production of the flash of light. The system also enables the use of a relatively small electronic switch as well as a relatively small voltage converter for charging the ignition capacitor.

16 Claims, 2 Drawing Figures

ELECTRONIC FLASH SYSTEM

The present invention relates to electronic flash systems and more particularly to an electronic flash system employing a much smaller supply capacitor than that conventionally used.

BACKGROUND OF THE INVENTION

Electronic photoflash systems and units for amateur and professional photography have become increasingly popular in recent years. A number of the early flash units required a separate power supply package, and when a photograph was being taken the flash unit emitted a given uncontrollable amount of light. The power supply typically employed a DC battery pack, a DC-to-DC converter, and a large capacitor which was charged by the battery and converter. Later automatic electronic flash units were developed based on the subject matter of Edgerton U.S. Pat. No. 3,033,988. Such units also employed a relatively large main capacitor, along with a compact DC battery source and converter for charging the capacitor. Automatic control of the light output was provided through the use of a light sensor circuit which detected when sufficient light had been received at the subject being photographed, and controlled a quench tube connected in parallel with the flashtube. With this arrangement, when sufficient light had been received, the remaining energy in the main storage capacitor was shunted past the flashtube thereby causing the flashtube to cease emitting light.

A further development, presently widely used in the photography field, was the series circuit or thyristor control circuit for automatic electronic flash units. In this system, an electronic switch is connected in series between the relatively large main capacitor and the flashtube, the series switch being turned off after sufficient reflected light had been received at a light sensor circuit. One of the benefits of the thyristor units is that the remaining energy in the main storage capacitor is conserved rather than wasted as was the case with the earlier shunt or bypass type automatic units. Examples of current commercially available thyristor flash units are, for example, the Vivitar Model 283 and Vivitar Model 285 electronic flash units. Further examples of automatic electronic flash systems employing a series circuit, and light sensor circuits therefor, are shown in U.S. Pat. Nos. 3,857,064 3,783,336, and 3,809,951, the disclosures of which are incorporated herein by reference. These patents describe several forms of series control circuits for electronic flash units, as well as forms of light sensor circuits for controlling the switching systems thereof. U.S. Pat. No. 3,591,829 also illustrate several series control circuits for flashtubes.

While both the series and shunt type automatic flash units have been made more compact and efficient, they all rely on the use of a relatively large and expensive main capacitor for supplying the energy to the flashtube. The main capacitor is charged from a set of batteries through a suitable relatively high power converter, all of which usually is contained within the flash unit housing. In the series circuit units an electronic switch having a high power rating is necessary because of the high current, such as several hundred amperes, required to be switched.

Although the aforementioned automatic electronic flash units have met with wide acceptance, they all make use of a large and expensive capacitor, which is usually referred to as a "main" capacitor. The capacity of such a capacitor typically is in the range of 500–1,000 microfarads, and the capacitor is charged to a voltage usually in the range of about three hundred to five hundred voltas. Upon discharge of the main capacitor in the flashtube, the current is in the order of two hundred to three hundred amperes for a time period usually not exceeding about one millisecond.

At least one electronic flash circuit has been proposed for obviating the need for the use of any capacitor in series with the flashtube. A system of this nature is shown in Japanese Patent Publication No. 10553/66 published June 10, 1966 based on an Application No. 6668/63 filed Feb. 9, 1963. The purpose described was to eliminate the main capacitor, which was said to comprise 50% of the entire weight of the flash unit, and to eliminate the waiting time for charging of a main capacitor. The system described employed a DC battery connected to the flashtube for igniting and supplying power to the flashtube. It is not known if this system was practical or ever commercially accepted. Furthermore, electronic flash systems have been described in which the voltage to which the main capacitor is charged can be reduced to minimize possible shock hazards or to enable different type flashtubes to be used. Examples are shown in U.S. Pat. No. 3,912,968 and No. 3,781,602. Both describe the use of a pair of charged capacitors in series with a flashtube, along with a switching arrangement for causing the voltages of the two capacitors to add to thereby provide sufficient voltage for both igniting and supplying power to the flashtube. However, all of these foregoing approaches require either a high voltage battery or a relatively large and expensive main capacitor.

The present invention pertains to an electronic flash system which does not require the usual large and expensive capacitor, but, instead, supplies power to a flashtube from a much smaller capacitor and a battery or other similar source. It is particularly applicable to automatic flash unit systems, such as of the series or thyristor type, and enables a fast flash recycle time and a large number of flashes for each battery charge. In an exemplary embodiment of the present invention, the flashtube is ionized in a conventional manner, and is ignited to commence its flash in a conventional fashion and at a conventional voltage, but this voltage is supplied by a relatively small capacitor. Then, a medium voltage battery or other suitable power supply, supplies the required medium current for a medium length of time and, in an automatic flash unit embodiment, this current is supplied through a medium size electronic switch which is controlled in a well known manner. Further, in an exemplary embodiment, a small capacitor, such as one-half to several microfarads supplies a voltage of approximately three hundred to five hundred volts for initially igniting the flashtube, for example, for the first twenty microseconds, and a sixty volt battery can supply medium current of approximately twenty amperes for maintaining and completing the flash, for such as ten milliseconds. The resulting light intensity waveform from the flashtube is lower in amplitude but longer in duration. For example, the amplitude, because of the reduced current, may be ten times less than with a conventional flash unit and typically will be approximately ten times longer such as approximately ten milliseconds instead of one millisecond, and this light intensity waveform falls within the good efficiency range of the flashtube. In addition to these benefits, the size, cost, and difficulties occasioned through the use of a large main capacitor, and the high transient currents involved, can be significantly reduced.

Accordingly, it is an object of this invention to provide an improved electronic flash system.

A further object of this invention is to provide an electronic flash system using a relatively small energy supply capacitor.

These and other objects and features of the present invention will become better understood through a consideration of the following description taken in conjunction with the drawing in which:

DETAILED DESCRIPTION OF THE PREFERRED EMBODIMENT

Figure 1:
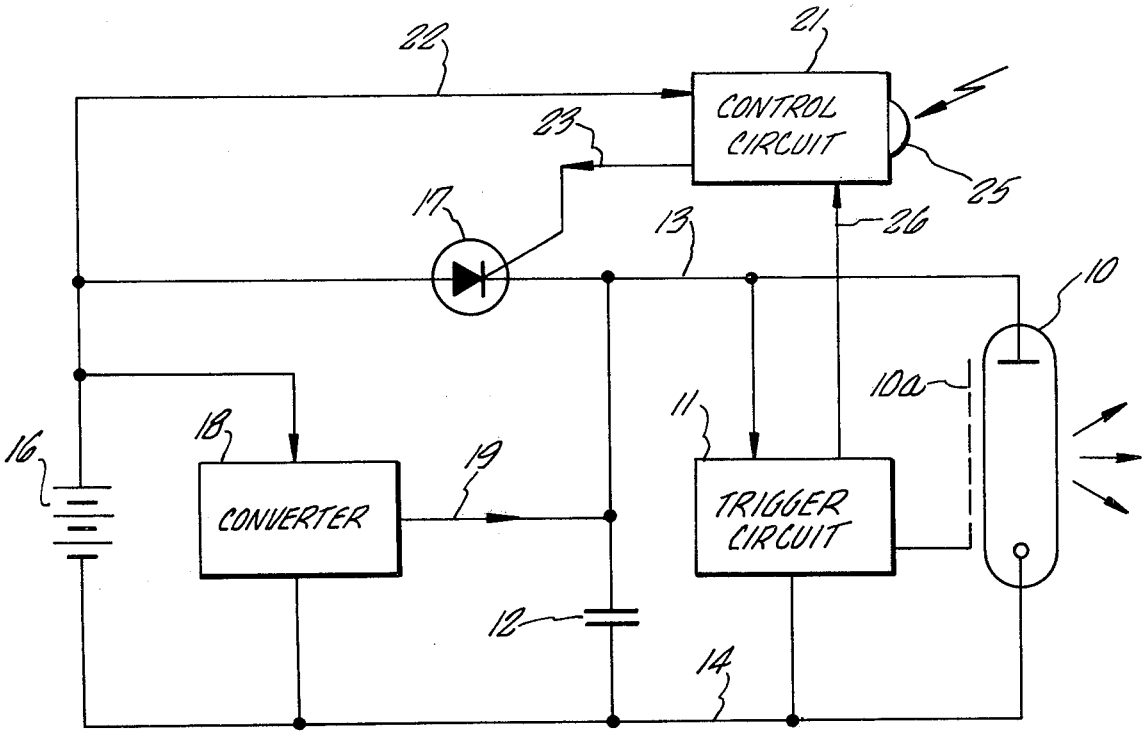
FIG. 1 is a block diagram of an electronic flash system according to this invention.

Turning now to the drawing, FIG. 1 is a combined block and circuit diagram of an exemplary embodiment of an electronic flash system according to the present invention. This embodiment is of an automatic electronic flash system wherein the flash of light is terminated when sufficient light has been received at the subject being photographed; however, the present invention is applicable to non-automatic systems. The system includes a Xenon flashtube 10 which is ionized in a conventional manner by a trigger circuit 11. A relatively small capacitor 12 is connected in parallel with the flashtube 10 by electrical conductors 13 and 14. A medium voltage battery 16, such as a sixty volt battery, is connected in parallel with the flashtube 10 through an electronic switch 17. This switch 17 acts as a controlled rectifier and allows current to flow only from the battery 16 toward the flashtube 10. A DC-to-DC converter 18 is connected across the battery 16, and has an output conductor 19 for charging the capacitor 12 to a relatively high voltage, such as three hundred to five hundred volts. Finally, the system of FIG. 1 includes a control circuit 21 which receives power from the battery 16 as schematically illustrated by a line 22, and functions to turn on the series switch 17 through a line 23 when the flashtube 10 is triggered by the trigger circuit 11. The control circuit 21 includes a light sensor 25 which responds to light from the flashtube 10 which is reflected from the subject being photographed, and causes the control circuit 21 to turn-off the series switch 17 when sufficient light has been received. The control circuit 21 is gated on when the trigger circuit 11 triggers the flashtube 10 as schematically illustrated by a line 26.

Considering first the basic operation of a conventional electronic flashtube circuit, and assuming for the moment that the capacitor 12 functions like a main capacitor of a conventional flash unit, the trigger circuit 11 is operated to cause the gas in the flashtube 10 to ionize. Typically, a switch (not shown), such as the sync contacts of a camera, operates the trigger circuit. The trigger circuit 11 conventionally includes a capacitor which is charged and when the sync contacts were closed, this capacitor discharges into the primary of a trigger transformer, the secondary of which is connected to a control electrode 10*a* of the flashtube 10. Trigger circuits of this nature are shown in U.S. Pat. Nos. 3,857,064, 3,783,336 and 3,809,951 referred to earlier. The trigger circuit 11 thus supplies a high voltage impulse to the control electrode 10*a* which, in turn causes the gas in the flashtube 10 to ionize. This causes the resistance of the flashtube to drop substantially, thereby allowing the capacitor 12 to discharge into the flashtube 10, igniting the flashtube and causing the flashtube to emit light. When the flashtube 10 is triggerd, the control circuit 21 is conventionally gated on to allow the light sensing circuit thereof to commence sensing the reflected light from the subject being photographed. The control circuit 21 may be gated on via the line 26 from the trigger circuit 11 in a manner similar to that shown in FIG. 1 of U.S. Pat. No. 3,783,336. Alternatively, the control circuit 21 may be gated on in other ways, such as illustrated in FIGS. 3 and 5 of U.S. Pat. No. 3,857,064.

In the usual conventional series or thyristor flash circuit, an electronic switch or thyristor (not shown) is connected in series between a capacitor 12 and the flashtube 10. The series switch is turned on at or about the same time as the flashtube 10 is triggered to allow the charge of the capacitor to be dumped into the flashtube. A light sensor or control circuit, like control circuit 21, subsequently causes the series switch to be turned off when sufficient light has been received by the subject being photographed.

Turning again to the preferred embodiment of FIG. 1, the circuit of FIG. 1 does not require a switch in series between the capacitor 12 and the flashtube 10. However, the series switch 17 is connected in series between the battery 16 and the flashtube 10. The switch 17 is operated in a manner like the usual series switch; that is, it is turned on when the trigger circuit 11 triggers the flashtube 10, and is turned off by the control circuit 21 when sufficient light has been received.

Turning now more specifically to the construction and operation of the system of FIG. 1, the flashtube 10, trigger circuit 11 and control circuit 21 are conventional components. On the other hand, the capacitor 12 can be substantially smaller than the typical main capacitor of an electronic flash unit. As noted earlier, a typical main capacitor has a capacitance of approximately 500–1,000 microfarads; whereas, the capacitor 12 can have a capacitance of one-half to several microfarads, typically one-half to five microfarads. This capacitor only supplies a low current, such as one to ten amperes depending on the capacity thereof, and usually the flashtube is totally ignited when one to two amperes is supplied. The term small or relatively small with respect to the capacitor 12 is used herein typically to mean a capacitor having a capacitance of several hundred to a thousand times smaller than the typical main capacitor. The battery 16 is a medium voltage battery, such as approximately fifty to sixty volts, which can supply a medium current pulse, such as twenty amperes, for a relatively short period of time typically not exceeding ten milliseconds. The battery could be larger, up to three hundred volts, but a large battery is expensive and bulky and a fifty to sixty volt battery is quite satisfactory.

The converter 18 is a conventional DC-to-DC converter, but since it does not have to charge a large capacity (e.g., 500–1,000 microfarads) main capacitor, it can be considerably more compact and faster, such as twenty times smaller and five times faster in operation to precharge the capacitor 12 to a conventionally high voltage. The conventional high voltage used in typical electronic flash units is in the range of three hundred to five hundred, and the converter 18 precharges the capacitor 12 to this voltage from the battery 16. However, the converter 18 can be several hundred times less powerful than conventional converters because of the very low power required to be supplied by the small capacitor 12. Finally, the electronic series switch 17 or thyristor can be smaller than is conventional. The conventional series thyristor must have a current carrying capacity in the order of two hundred amperes; whereas, the rating of the switch 17 can be of the order of twenty amperes.

Considering further the operation of the system of FIG. 1, the battery 16 charges the small capacitor 12 via the converter 18 to a conventional voltage such as three hundred to five hundred volts. When it is desired to flash the flashtube 10, the trigger circuit 11 is operated in a conventional manner, as from the sync contacts of a camera (not shown), to cause ionization of the flashtube 10. When the flashtube 10 is ionized, current flows from the charged capacitor 12 into the flashtube 10 to ignite the flashtube and cause it to commence emitting light. The trigger circuit 11 also causes the electronic switch 17 to be turned on through the line 26, control circuit 21 and line 23. When this switch 17 is turned on, the battery 16 supplies current to the flashtube 10 as soon as the voltage of the capacitor 12 (at the cathode of 17) falls below the voltage of the battery 16 (at the anode of 17). Thus, with a thyristor used as the switch 17 current is supplied by the battery 16 to the flashtube 10 when the gate of thyristor 17 is activated and, because of the diode action of 17, the voltage of the capacitor 12 falls below the voltage of the battery 16. The time at which the battery 16 takes over and supplies current thus depends upon how fast the voltage of the capacitor 12 falls below the battery voltage. If it is desired to use other forms of electronic switches such as a field effect transistor a diode can be connected in series with the transistor to provide this diode action.

Accordingly, the trigger circuit 11 triggers the flashtube 10 and ionizes the gas therein, the voltage on the capacitor 12 ignites the flashtube 10 since it takes a relatively high voltage (but low current) to ignite the flashtube, and the battery 16 supplies the majority of the current required to cause the flashtube 10 to generate the light output since only a relatively low voltage and current is necessary to accomplish this once the flashtube 10 is ignited. When sufficient light has been received at the subject being photographed and is reflected back to the light sensor 25, the control circuit 21 provides a signal on line 23 to turn off the switch 17. As will be apparent to those skilled in the art, the switch 17 can be commutated in a conventional manner as described in U.S. Pat. Nos. 3,857,064, 3,783,336 or 3,809,951 to cause the switch 17 to turn off.

Figure 2:
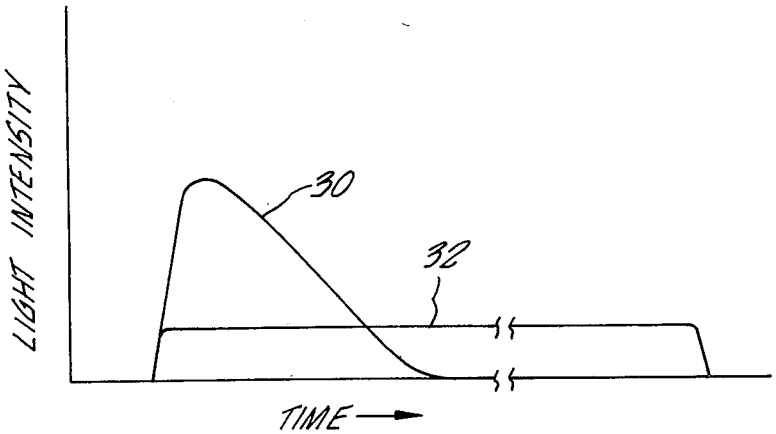
FIG. 2 shows waveforms comparing the light intensity output of the present flash system with a typical prior flash system.

FIG. 2 diagrammatically illustrates the light output of the conventional electronic flash unit and the light output of an electronic flash unit using the system of FIG. 1. A curve 30 illustrates the typical light intensity with respect to time waveform of a conventional electronic flash unit emitting its maximum amount of light; that is, the flashtube is not turned off before the main capacitor substantially fully discharges through the flashtube. The curve 32 diagrammetically illustrates the light intensity with time waveform of the light emitted by the flashtube 10 of the system of FIG. 1. In this case, the amplitude of the curve 32 is about five times less than the peak intensity of the curve 30. However, the duration of the curve 32 will be approximately five times longer resulting in a maximum flash duration of about five milliseconds rather than the conventional maximum period of one millisecond. Even so, five milliseconds is well within a 1/60th second or a 1/100th second camera shutter speed. The curves 30 and 32 depict typical full length durations of a flash, but, as will be apparent to those skilled in the art, with an automatic electronic flash system using the control circuit 21 of FIG. 1, the flash duration of curve 32 may be substantially shorter if sufficient light is received earlier at the subject being photographed. A typical flash time range with the present system is approximately twenty microseconds to ten milliseconds. The light power output as illustrated by curve 32 thus is in the form of a medium rectangular pulse instead of the typical high peak pulse of curve 30, and the form and duration of the light power output 32 is easier to control and better matches the efficiency range of a conventional Xenon flashtube 10.

While a preferred embodiment has been described and illustrated, it will be apparent to those skilled in the art that changes can be made made therein without departing from the present invention.

What is claimed is:

1. An electronic flash system comprising, a flashtube for emitting a flash of light when ionized and ignited, trigger circuit means connected with the flashtube for triggering the flashtube to ionize, a relatively small capacitor means, and means connecting said capacitor means in parallel with said flashtube for igniting the flashtube when the same is ionized, and DC power source means for supplying a medium voltage and current to said flashtube to cause the flashtube to generate a light output after the flashtube is ignited by the capacitor means, and controllable switch means connecting said power source means in parallel with said flashtube to reduce the typical peak light intensity from the flashtube and to provide a relatively level light output from the flashtube.

2. An electronic flash system as in claim 1 wherein said power source means comprises a battery, and said switch means connecting said power source means in parallel with said flashtube comprises electronic switch means which supplies current to said flashtube when the voltage of said capacitor means falls below the voltage of said power source means and which includes a control electrode for facilitating termination of current flow from said power source means to said flashtube.

3. An electronic flash system as in claim 2 wherein said electronic switch means comprises a thyristor.

4. An electronic flash system as in claim 1 including converter means for charging said capacitor means from said power source means to a voltage within the range of approximately three hundred to five hundred volts for igniting said flashtube when the flashtube is triggered by said trigger circuit means, said power source means comprises a battery, and said switch means connecting said power source means in parallel with said flashtube means comprises an electronic switch.

5. An electronic flash system as in claim 4 wherein said battery comprises a battery having a voltage output of approximately sixty volts and a peak current output of up to approximately twenty amperes for a maximum transient period of approximately ten milliseconds.

6. An electronic flash system as in claim 1 wherein said switch means connecting said power source means in parallel with said capacitor means comprises electronic switch means which allows current to flow from said power source means to said flashtube only when the voltage of said capacitor means falls below a predetermined value.

7. An electronic flash system as in claim 6 wherein said predetermined value is the voltage of said power source means.

8. An electronic flash system as in claim 1 including converter means for charging said capacitor means from said power source means to a voltage within the range of approximately three hundred to five hundred volts for igniting said flashtube when the flashtube is triggered by said trigger circuit means, said power source means comprises a battery, and said switch means connecting said power source means in parallel with said flashtube comprises a thyristor.

9. An electronic flash system as in claim 1 wherein said capacitor means comprises a capacitor having a capacitance within the range of one-half to several microfarads.

10. An electronic flash system comprising a flashtube for emitting a flash of light when ionized and ignited, trigger circuit means connected with the flashtube for triggering the flashtube to ionize, relatively small capacitor means, and means connecting said capacitor means in parallel with said flashtube for igniting the flashtube when the flashtube is ionized, means connected with the capacitor means for charging said capacitor means to a voltage sufficient to ignite said flashtube, DC power source means for supplying a medium voltage and current to said flashtube to cause the flashtube to generate a light output after the flashtube is ignited by the capacitor means, and electronic switch means connected in series between the DC power source means and the flashtube, said electronic switch means allowing current to flow from said power source means to said flashtube when the voltage of said capacitor means falls below the voltage of said power source means and said electronic switch means having a control electrode for facilitating termation of current flow from said power source means to said flashtube.

11. An electronic flash system as in claim 10 wherein said electronic switch means comprises a thyristor, and said power source means comprises a battery having a voltage output of approximately sixty volts.

12. An electronic flash system comprising a flashtube for emitting a flash of light when ionized and ignited, trigger circuit means connected with the flashtube for triggering the flashtube to ionize, capacitor means connected in parallel with said flashtube for igniting the flashtube when the flashtube is ionized, converter means connected to said capacitor means for charging said capacitor means to a voltage within the range of approximately three hundred to five hundred volts, battery means for supplying a substantially lower voltage as compared to the voltage of said capacitor means to said flashtube to cause the flashtube to generate a light output after the flashtube is ignited by the capacitor means, electronic switch means connected between said battery means and the flashtube for allowing current to flow from said battery means to said flashtube only when the voltage of said capacitor means falls below the voltage of said battery means, and control circuit means connected with said switch means and including light sensor means responsive to light reflected from a subject to be photographed and for causing said electronic switch means to turn off when a predetermined amount of light has been received by a subject being photographed.

13. A method of providing a flash of light from an electronic flashtube comprising the steps of triggering the flashtube to ionize the gas therein, igniting the flashtube from a high voltage low capacity capacitor, and supplying power to the flashtube from a separate DC voltage source of medium voltage as compared to the high voltage of said capacitor and of medium amperage for a controlled time period not exceeding approximately ten milliseconds to provide a relatively level flash light output from the flashtube.

14. A method of providing a flash of light from an electronic flashtube comprising the steps of, triggering the flashtube to ionize the gas therein, igniting the flashtube from a high voltage low capacity capacitor, supplying power to the flashtube from a battery of medium voltage as compared to the high voltage of said capacitor when the voltage of the capacitor falls below the voltage of the battery, and terminating said supply of power to the flashtube as a function of the light output of the flashtube.

15. An electronic flash system comprising a flashtube for emitting a flash of light when ionized and ignited, trigger circuit means connected with the flashtube for triggering the flashtube to ionize, a relatively small capacitor means, and means connecting said capacitor means in parallel with said flashtube for igniting the flashtube when the same is ionized, DC power source means for supplying a medium voltage and current to said flashtube to cause the flashtube to generate a light output after the flashtube is ignited by the capacitor means, and electronic switch means connecting said power source means in parallel with said flashtube for allowing current to flow from said power source means to said flashtube only when the voltage of said capacitor means falls below a predetermined value, and light sensor control circuit means responsive to the triggering of said flashtube for turning on said electronic switch means, said control circuit means including light sensor means responsive to light reflected from a subject to be photographed and for causing said electronic switch means to turn off when a predetermined amount of light has been received by a subject being photographed.

16. An electronic flash system as in claim 15 wherein said power source means comprises a battery having a voltage output of approximately sixty volts and a peak current output of up to approximately twenty amperes for a maximum transient period of approximately ten milliseconds, and said capacitor means comprises a capacitor having a capacitance within the range of one-half to several microfarads.

* * * * *